US005337917A

United States Patent [19]

Pierce

[11] Patent Number: 5,337,917

[45] Date of Patent: Aug. 16, 1994

[54] CRASH RESISTANT CONTAINER

[75] Inventor: Jim D. Pierce, Albuquerque, N. Mex.

[73] Assignee: Sandia Corporation, Albuquerque, N. Mex.

[21] Appl. No.: 25,306

[22] Filed: Mar. 2, 1993

Related U.S. Application Data

[63] Continuation-in-part of Ser. No. 779,662, Oct. 21, 1991, abandoned.

[51] Int. Cl.[5] ..... B65D 90/04

[52] U.S. Cl. ..... 220/468; 220/421; 220/444; 220/464; 220/469; 250/506.1

[58] Field of Search ..... 206/3, 524, 524.4, 591, 206/592, 594; 220/4.04, 4.05, 4.09, 421, 424, 423, 444, 468, 466, 469, 464; 250/506.1, 507.1, 515.1

[56] References Cited

U.S. PATENT DOCUMENTS

| | | | |
|---|---|---|---|
| Re. 24,767 | 1/1960 | Simon et al. | 206/524 |
| 1,041,347 | 10/1912 | Potter | 220/4.04 |
| 2,403,836 | 7/1946 | Wagner | 154/43.5 |
| 3,009,601 | 11/1961 | Matsch | 220/424 |
| 3,101,862 | 8/1963 | Matsch | 220/424 |
| 3,108,706 | 10/1963 | Matsch et al. | 220/424 |
| 3,167,933 | 2/1965 | Beckman et al. | 220/423 |
| 3,215,313 | 11/1965 | Stelts | 220/424 |
| 3,432,666 | 3/1969 | Nash | 250/506.1 |
| 3,466,662 | 9/1969 | Blum | 220/464 |
| 3,598,275 | 8/1971 | Francola | 220/469 |
| 3,608,769 | 9/1971 | Gablin | 220/466 |
| 3,669,299 | 6/1972 | Jones et al. | 220/464 |
| 3,786,956 | 1/1974 | Tabor | 220/63 R |
| 3,888,557 | 6/1975 | Anderson et al. | 220/464 |
| 3,970,208 | 7/1976 | Raes | 220/464 |
| 4,010,690 | 3/1977 | Cocozella et al. | 206/3 |
| 4,016,997 | 4/1977 | Roffler | 220/468 |
| 4,175,669 | 11/1979 | Housholder et al. | 220/464 |
| 4,190,160 | 2/1980 | Andersen et al. | 206/591 |
| 4,248,342 | 2/1981 | King et al. | 206/3 |
| 4,286,723 | 9/1981 | Schutz | 220/4.04 |
| 4,347,929 | 9/1982 | Poe et al. | 206/3 |
| 4,376,489 | 3/1983 | Clemens | 220/1.5 |
| 4,428,998 | 1/1984 | Hawkinson | 428/240 |
| 4,432,285 | 2/1984 | Boyars et al. | 206/3 |
| 4,528,454 | 7/1985 | Baatz et al. | 250/506.1 |
| 4,569,818 | 2/1986 | Popp et al. | 250/506.1 |
| 4,588,088 | 5/1986 | Allen | 206/524 |
| 4,625,122 | 11/1986 | Botzem et al. | 250/506.1 |
| 4,752,437 | 6/1988 | Ito et al. | 250/506.1 |
| 4,778,628 | 10/1988 | Saha et al. | 250/506.1 |
| 4,783,309 | 11/1988 | Popp et al. | 250/507.1 |
| 4,793,491 | 12/1988 | Wolf et al. | 220/466 |
| 4,845,372 | 7/1989 | Mallory et al. | 250/506.1 |
| 5,029,699 | 7/1991 | Insley et al. | 206/594 |

*Primary Examiner*—David T. Fidei
*Attorney, Agent, or Firm*—Gregory A. Cone

[57] ABSTRACT

A container for hazardous materials capable of protecting the enclosed materials from high speed impact. Energy absorption is provided by a multiplicity of crushable layers of either wire mesh or perforated metal sheets which thin and flow together under impact loading. Layers of a higher tensile strength material are interspersed within the crushable layers to confine them and increase performance.

12 Claims, 1 Drawing Sheet

CRASH RESISTANT CONTAINER

The government has rights in this invention pursuant to Contract No. DE-AC04-76DP00789 awarded by the U.S. Department of Energy.

This is a continuation in part of U.S. patent application Ser. No. 07/779,662 filed Oct. 21, 1991, now abandoned. This application is incorporated by reference in its entirety.

BACKGROUND OF THE INVENTION

This invention relates to an impact-resistant energy absorbing container for transporting a load, particularly a load of hazardous materials.

The storage and transportation of hazardous materials presents a number of unique challenges. Some of the prior art reflects solutions to the problem of shielding nearby objects from the effects of explosion of the hazardous material by designs that damp the shock waves and confine the debris produced by the explosion. Other references show construction details of various containers that shield a load from impacts, fire, puncture, immersion, and the rest of the variety of adverse conditions that can adversely affect the load during storage and transportation. The need for a container that can withstand all of the more normal types of impacts contemplated by the prior art structures as well as those contemplated by new government regulations covering the air transportation of nuclear materials has now created a requirement for a container with capabilities to withstand very high speed impacts with subsequent fires and immersion without the escape of the material within the load into the environment. The present invention is the only container design known that is capable of meeting this increased level of protection.

SUMMARY OF THE INVENTION

The load may be either a solid (granulated, powder or a continuous solid) or a fluid that is contained within a relatively simple vessel that is not necessarily designed for impact resistance. This load is surrounded by the inner wall of the container of this invention which restrains the load from any but insignificant movement of the load relative to the container. An intermediate region of the container then surrounds the inner wall. This intermediate region has a large number (at least 200) of layers of a plastically deformable metallic mesh or perforated sheets in which are interspersed a smaller number of layers of a high tensile strength mesh that act to confine the plastically deformable layers so that ruptures in the lower strength deformable layers do not propagate past the interspersed high tensile layers. For applications that require shielding from external fires, additional layers of non-combustible material are provided in this intermediate region or at the outer perimeter. An outside wall is provided for the container to shield the intermediate region from normal wear and tear and also puncture and fluid infiltration in the event of a high speed impact. Such a container is able to withstand impacts at over 400 feet per second without unacceptable damage to the load.

BRIEF DESCRIPTION OF THE DRAWING

The drawing FIGURE is a cut away isometric view of one embodiment of the container.

DETAILED DESCRIPTION OF THE INVENTION

Figure 1:
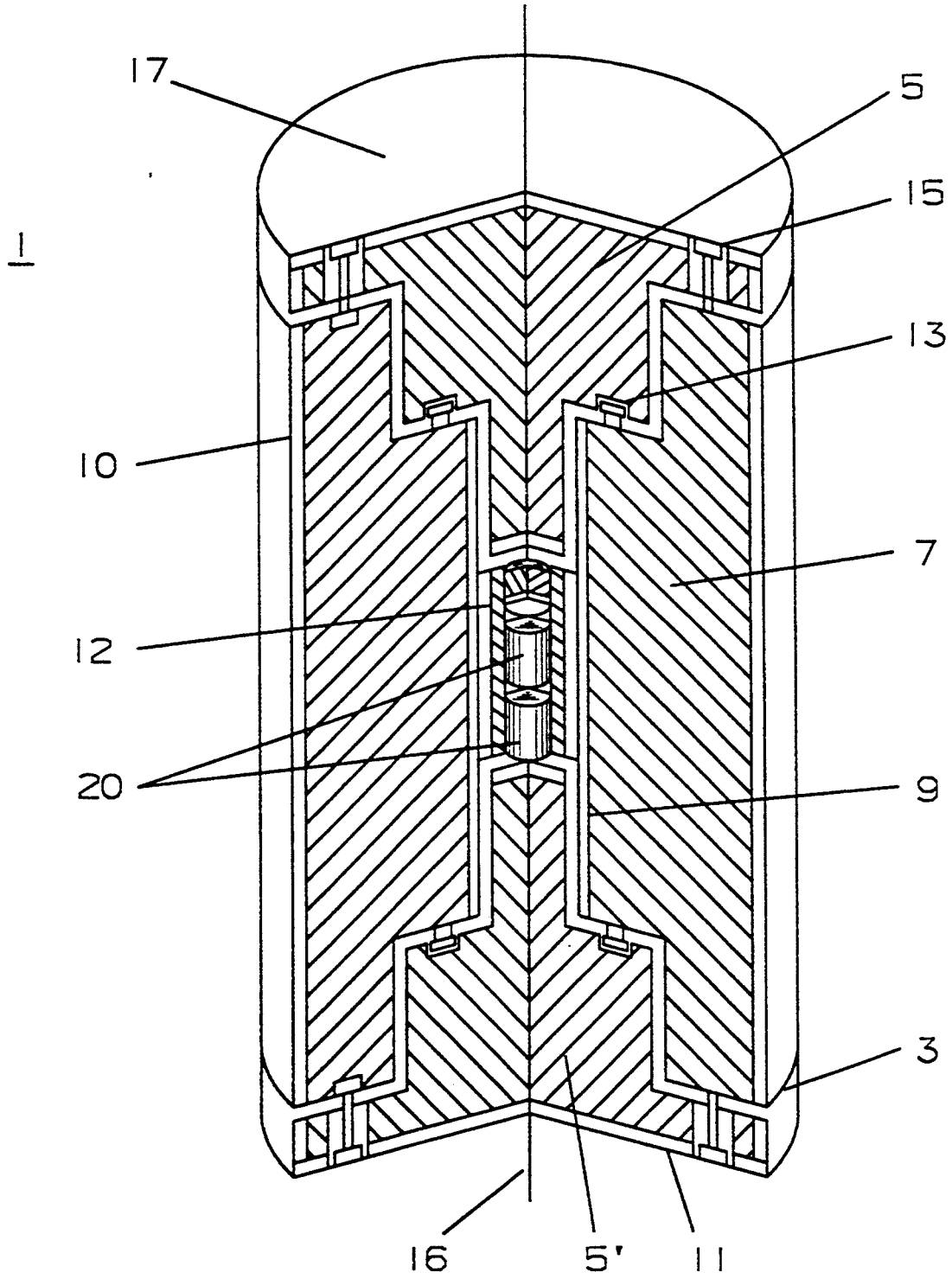

The container described herein is designed to meet new requirements for impact, fire and puncture resistance and to be able to be scaled up or down to meet a wide range of requirements for various contents and regulations. It utilizes a very robust primary container for protection and confinement of an inner containment vessel which carries the actual contents/load. This primary container has an outer wall or shell, an intermediate region with multiple layers of plastically-deformable metallic wire mesh or perforated sheets and high-tensile strength materials, and an inner wall surrounding the inner containment vessel carrying the load. This provides energy absorption for the load as well as thermal protection. The use of intermittent layers with high tensile strength results in a limiter which remains in place during accidental impact events and can be relied upon to provide subsequent puncture and fire protection. In addition, the outer wall around the energy absorbing region is provided for handling and weather protection.

The design has been validated by scoping tests with various material samples, wall samples and partially modeled prototypes. Finite element analyses have been performed to evaluate various design features. Multiaxial compression and tension experiments were performed on various candidate materials to obtain appropriate material properties for the model. Scale model containers were subjected to side and end impacts for analysis. Prototype scale model packages were fabricated and subjected to 129 meters/second side impact and 200 m/s end impact tests. Test results indicated that the container would remain intact throughout a worst case accident and that structural loads on the inner containment can be limited to the extent necessary to maintain its integrity.

The container was designed to satisfy and exceed the requirements for a large plutonium air transport package as prescribed in NUREG-0360 and the more recent Public Law 100-203. The sequential test environments in NUREG-0360 require that a load weighing more than 227 kg must be subjected to and not release an A2 quantity of material in one week are: (1) a 129 m/s perpendicular impact onto a flat unyielding target in the most severe location, (2) a 3-m drop onto a conical steel puncture probe in the most severe location, (3) two slash tests by a 45-kg section of structural steel dropped 46 m onto the package, (4) a fully-engulfing JP-4 fire test for a period of no less than one hour, and (5) a 1-m submersion test in water for a period of 8 hours. Recent U.S. legislation (U.S. Public Law 100-203) also requires that foreign shipments of plutonium through U.S. airspace be able to withstand a worst-case aircraft crash; therefore, the requirements for containers used for these applications are expected to be even more severe. Although designed for this application, this invention will find a variety of other uses for other types of loads, be they hazardous materials or whatever. In these other applications, modifications to the specific embodiment discussed below may be made to provide for a better match to these other applications. For example, there may be situations for which fire protection is not necessary.

The container has three elements. The first is the inner wall or shell. If the load contents are confined by an inner containment vessel of sufficient strength, this inner containment vessel wall can serve as the inner wall of the container. It would be more usual however to provide for a separate inner wall for the container which surrounds the wall of the inner containment vessel and closely fits around it to prevent significant relative movement between the two. The second element is the intermediate energy absorbing region. Multiple layers of wire mesh or perforated sheets are provided as the primary energy absorbing element. This material may have various wire sizes, various mesh spacings in the case of the mesh, various thicknesses, hole diameters and spacings for the perforated sheets, and may be aluminum, corrosion resistant steel, titanium, or other suitable material depending on the requirements. Within the wire screen or perforated sheet layers are interleaved layers of high tensile strength fabric which act to confine the wire layers in an impact and for puncture protection. This material may be polyaramid fiber cloth, S-2 glass, graphite, or other suitable cloth-like material depending on the application. Layers of insulation material may also be included if necessary for thermal protection. This may be interleaved with the wire mesh layers and also employed as multiple layers at the outside surface of the intermediate region. The radial thickness of the energy absorbing region will normally range from about 6 inches to 24 inches or more depending on the anticipated impact. Finally, the third element is the outer wall or shell which covers and protects the materials in the intermediate region. This outer wall may be made of corrosion resistant steel, aluminum, resin impregnated cloth or other suitable material. For air transport containers resistant to very high speed crash impacts, the weight ratio of load to container will normally be less than about 15%. For ground transport containers, the ratio can range much higher to about 75% depending on impact speeds. Clearly, the higher speed impacts require greater thicknesses for the energy absorbing regions.

The actual energy absorption happens through the crushing and plastic flow of the metallic mesh or the perforated sheet. In the mesh, the wires flow together and end up as a very much flattened and reduced thickness, quasi-continuous solid layer in their end state. The perforated sheets thins as the material in the sheets flows into the holes and again forms a continuous solid sheet in its end state.

A specific embodiment capable of carrying 7.8 kg of plutonium was developed and is shown in the drawing figure. The container 1 utilizes a robust inner wall 12 fabricated from a titanium alloy with a 2.5 cm sidewall that can carry various configurations of inner containment vessels 20. It is desirable to provide for the insertion of packing material between the inner containment vessels 20 carrying the load and the inner wall 12 of the container to prevent significant relative movement between these two elements. This packing is not shown in the drawing. The intermediate energy absorbing region is here realized as three subregions, the lateral subregions 7 in which the layers are oriented parallel to the longitudinal axis 16 of the container and the two stepped end plugs 5, 5' in which the layers are oriented perpendicular to the longitudinal axis. The layers in the lateral subregion are 60 cm thick at the widest portion, and the layers in the end plugs are a maximum of 120 cm thick. The end plugs are held in place by keyed pins 13 and bolts 15. The outer wall has three separate subelements, upper end 17, lower end 11, and lateral area 10, corresponding to the three subregions of the intermediate energy absorbing region. The outer wall was made of 1.5 mm thick 304 stainless steel.

Many static tests were performed on small samples and wall sections of various wire mesh and high-tensile strength cloth materials. Dynamic tests were then performed on scale model prototypes. The preferred material for air transport applications was found to be aluminum wire mesh. The high-tensile strength cloth materials had less utility as energy absorbers but were very necessary to provide confinement of the wire mesh, to spread the load from a puncture environment over a much larger area, and to provide a degree of thermal protection for the contents of the intermediate energy absorbing zone.

Several radial sample wall sections with polyaramid cloth included a multiple locations in the wire mesh were tested to failure by crushing in the same configuration as a dynamic side impact test. A significant improvement in confinement was observed with the addition of the polyaramid cloth, approximately a factor of four over a configuration without the cloth.

The data from these tests were used to design and fabricate a simple quarter-scale wire mesh model capable of carrying 8 kg of PuO2 but actually filled with lead shot. The construction of this model was somewhat simpler than that shown in the drawing in that this model did not have an outer shell. During manufacture of the quarter scale model, the layers of the energy absorbing region were wound around the inner containment vessel rather than stacked as they were for the multiaxial compression tests. The winding process generates a compressive stress between the layers, and the layers are therefore precompressed prior to the impact event. The amount of precompression will depend on the winding tension and radial location in the winding. Layers nearer the inner confinement vessel will be precompressed significantly more than those near the outer surface of the structure. The cylindrical portion of the model, corresponding to the lateral subregion 7 of the drawing, contained 30 layers of Kevlar® aramid fabric and 208 layers of aluminum screen wire interleaved together. The aramid fabric layers alone will give the energy absorbing region an initial tensile strength of 8615 psi in a circumferential direction. As the layered material is crushed, the spacing between the aramid fabric layers will decrease as the aluminum screen layers are crushed. This will act to increase the total tensile strength of the crushable region if the aramid layers are not damaged. Simulations indicate that tensile loading on the aramid layers for 425 feet per second impacts will not exceed the breaking strength of these layers. The overall diameter of the model was about 12 inches, with the inner containment vessel being about 2 inches in diameter.

This model was subjected to a side impact reverse ballistic test at the 3 km rocket sled track at Sandia National Laboratory-Albuquerque. A 273 kg steel target mounted to a rocket sled with a catcher box was impacted onto the test model at 129 m/s (approximately 425 feet per second). The intermediate energy absorbing region or overpack remained completely intact, and the inner containment vessel carrying the load, which was fabricated of low carbon steel, sustained minimal (approximately 3% maximum at the center of the cylinder) deformation. The energy absorbing region deformed radially about 2.75 inches from its original radial dimension of about 5 inches. The low carbon steel shell around the simulated load ovalized and deformed 0.082 inches near its midplane.

A modified quarter scale model of the air transport container shown in the drawing was subjected to an end impact with an impact velocity of 650 feet per second (fps) at the rocket sled test facility. The model omitted the outer shell and included aluminum spreader plates as part of the end caps. These spreader plates were located at the level of the locking pins 13 and extended radially to about the position of these pins. Also, a single shot container was used, and the remaining vertical space at the interior of the container was filled with further layers of aluminum screen/aramid fabric as well as two spacers made of multiple layers of 0.060" perforated aluminum sheets having 0.125" diameter holes spaced 0.200" apart located above and below the simulated load container. The perforated spacers performed in crush tests much like a rigid foam but have the advantage of nonflammability. The overall diameter was 14.5 inches and the overall height was 32.0 inches. The end caps were made by simply stacking up the layered material inside a stainless steel shell and manually compressing the layers an undefined amount. These end caps had approximately 60 layers of the wire mesh and 4 layers of aramid fabric per inch of thickness. An end-on impact test at 650 fps was conducted. The titanium inner confinement vessel containing the lead shot had its maximum outside diameter increased 0.10 inches due to liquification of the lead shot which caused a great increase in hydrostatic pressure resulting in the bulge. Subsequent analysis indicated that the deformation would not have occurred absent this melting of the lead.

A similar quarter scale air transport container model as constructed for a side impact test at 428 fps. This model omitted the aluminum spreader plates and the perforated aluminum spacers but included a 304 stainless steel shell. The cylindrical portion corresponding to the lateral portion 7 in the drawing contained 24 layers of aramid fabric and 374 layers of aluminum screen wire. The aluminum mesh had a wire diameter of 0.011 inches and a tensile strength of about 75 pounds per inch of width. The Kevlar ® fabric had a thickness of 0.017 inches and a tensile strength of about 1400 pounds per inch of width. Simulation indicated that at least some of the aramid layers would fail at the higher 650 fps impact loadings, and it is recommended that more aramid fabric layers be included for these conditions. The inner containment vessel was made from titanium for this model and did not deform at the 428 fps impact level.

Thermal tests were also conducted. A partial one dimensional test article with the same composite makeup as an actual prototype was fabricated for each test. The test articles were subjected to a thermal environment for 30 minutes and for 60 minutes to establish the preliminary thermal properties for the container. Initial results indicate that, depending on the heat load generated by the load itself (fissile materials generate heat in the load), the inner containment vessels will remain below the maximum allowable temperatures. Analyses performed on a package with approximate dimensions of only one fourth those for this package indicate temperatures would be below the allowable temperatures for elastomeric seals on the inner confinement vessel in a 30 minute fire. The results were conservative and did not account for heat flow through the outer wall of the container, indicating that the temperature rise in a fire is not a major design problem so long as the inner containment vessel remains surrounded by the overpack.

I claim:

1. A crash resistant container comprising:

an inner wall surrounding and restraining a load, an intermediate crushable region surrounding the inner wall comprising at least 200 layers of a deformable metallic material containing voids wherein the energy of a crash is absorbed by plastic flow of the metallic material into the voids, and at least one layer of a non-combustible insulating material wherein there are at least ten layers of the metallic material for each layer of the non-combustible insulating material, an outer wall surrounding the intermediate region.

2. The container of claim 1 wherein the metallic material is selected from the group consisting of aluminum wire mesh, corrosion resistant steel wire mesh, titanium wire mesh, perforated aluminum sheet, perforated corrosion resistant steel sheet, or perforated titanium sheet.

3. The container of claim 1 wherein the non-combustible insulating material comprises ceramic cloth.

4. A crash resistant container comprising:

an inner wall surrounding and restraining a load, an intermediate crushable region surrounding the inner wall comprising at least 200 layers of a deformable metallic material containing voids wherein the energy of a crash is absorbed by plastic flow of the metallic material into the voids and additional layers of a second material comprising a mesh having a higher tensile strength than the deformable metallic material interleaved with the layers of the metallic material wherein there are at least 3 layers of the metallic material for every one layer of the higher tensile strength mesh, and an outer wall surrounding the intermediate region.

5. The container of claim 4, wherein the metallic material is selected from the group consisting of aluminum wire mesh, corrosion resistant steel wire mesh, titanium wire mesh, perforated aluminum sheet, perforated corrosion resistant steel sheet, or perforated titanium sheet.

6. The container of claim 4 wherein the higher tensile mesh comprises a material having a tensile strength per inch of width per layer of greater than about 1000 pounds.

7. The container of claim 4, wherein the intermediate region further includes at least one layer of a non-combustible insulating material wherein there are at least ten layers of the metallic material for each layer of the non-combustible insulating material.

8. A crash resistant container comprising:

an inner wall surrounding and restraining a load, an intermediate crushable region surrounding the inner wall consisting essentially of at least 200 layers of a deformable aluminum wire mesh, additional layers of a polyaramid fiber mesh interleaved with the layers of the wire mesh wherein there are at least three layers of wire mesh for every layer of polyaramid fiber mesh, and at least one layer of a non-combustible insulating material wherein there are at least ten layers of the wire mesh for every layer of the insulating material, and an outer wall surrounding the intermediate region.

9. The container of claim 1 wherein the deformable metallic material is wire mesh.

10. The container of claim 1 wherein the deformable metallic material is perforated metal sheet.

11. The container of claim 4 wherein the deformable metallic material is wire mesh.

12. The container of claim 4 wherein the deformable metallic material is perforated metal sheet.

* * * * *